United States Patent [19]

Davis

[11] 3,955,817

[45] May 11, 1976

[54] TOY BOOMERANG

[75] Inventor: James E. Davis, Winter Park, Fla.

[73] Assignee: Spiral Productions, Inc., Winter Garden, Fla.

[22] Filed: Aug. 23, 1973

[21] Appl. No.: 390,949

[52] U.S. Cl. ..... 273/106 D; 46/74 D; 273/106 B

[51] Int. Cl.[2] ..... A63B 65/08; A63H 27/12

[58] Field of Search ..... 273/106 D, 106 B, 105.4; 46/74 D, 82, 83, 76 A

[56] References Cited

UNITED STATES PATENTS

| | | | |
|---|---|---|---|
| 1,671,225 | 5/1928 | Carlson | 46/76 R |
| 2,051,151 | 8/1936 | Northrop | 46/83 |
| 2,560,742 | 7/1951 | Reder | 46/76 R |
| 2,816,764 | 12/1957 | Gleason | 273/106 D |
| 3,082,572 | 3/1963 | Knox, Jr. | 46/74 D X |
| 3,403,910 | 10/1968 | Claycomb | 273/106 D |
| 3,565,434 | 2/1971 | Liston | 273/106 D |
| 3,570,467 | 3/1971 | Belokin, Jr. | 273/105.4 X |

*Primary Examiner*—Paul E. Shapiro

[57] ABSTRACT

A toy boomerang having a hub and four wings extending therefrom, the wings having downwardly extending lifting surface at wing tips. A rim extends around the boomerang, coupling together the wing tips. A stabilizing axle extends downward from the hub.

1 Claim, 5 Drawing Figures

TOY BOOMERANG

BACKGROUND OF THE INVENTION

This invention relates to flying toys and particularly to a toy boomerang.

GENERAL DESCRIPTION OF THE PRIOR ART

Previously known types of toy boomerangs have largely gone out of use and are not seen too often. In general, they have employed two or four blades with a common center. It is believed that the reason why toy boomerangs have not enjoyed continued success is that they were not easily operated to cause them to return to the operator, they were rather unstable and were not too safe.

SUMMARY OF THE INVENTION

It is, accordingly, the object of the present invention to overcome the aforesaid difficulty and to provide a toy boomerang which is easily operated, performs well and yet is quite safe.

In accordance with the invention, a boomerang is constructed of three or more, typically four, equally angularly spaced airfoils, each having an upper convex surface and a lower concave surface. The outer ends of the airfoils have downwardly extending lift members and the tips of the wings are connected by a rim which provides momentum for rotation and safeguards the user from the leading rotating edges of the rotating airfoils.

DESCRIPTION OF THE PREFERRED EMBODIMENT

Figure 1:
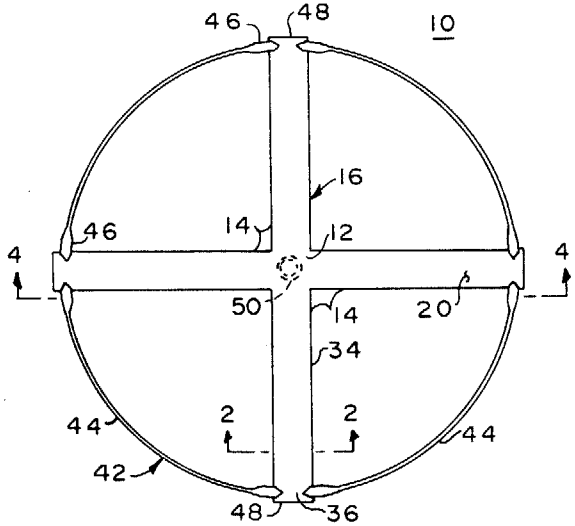
FIG. 1 is a top view of an embodiment of the invention.

Referring to the drawings, toy boomerang 10 includes symmetrical central hub 12 which interconnects four similar radially disposed blades 14, being oriented in a mutually perpendicular relationship, to form a lifting rotor assembly 16 (FIG. 1).

Figure 2:
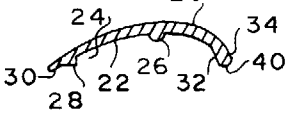
FIG. 2 is a sectional view along lines 2—2 of FIG. 1.

The central longitudinal body 18 of each of blades 14 is essentially a concave-convex wedge structure in cross section (FIG. 2) and the upper or convex surface 20 is configured to form an efficient airfoil which is similar to that of the familiar Davis Aircraft wing.

Figure 3:
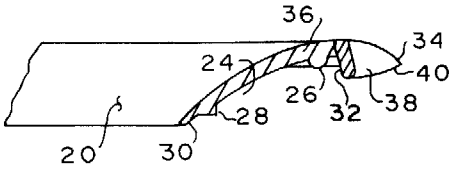
FIG. 3 is an enlarged pictorial view of the end region of one of the airfoils of the invention.

The lower concave surface 22 of each blade 14 is modified for rotary flight mode, being configured into a longitudinal channel 24 interrupted by an intermediate semicircular strengthening rib 26 and an essentially triangular strengthening rib 28 disposed along and inward of, trailing flange 30 (FIGS. 2 and 3) of each channel 24. The leading flange 32 of channel 24, is forwardly inclined and symmetrically spaced inward of leading edge 34 of blade 14. The free or outward end 36 of each (FIG. 3) channel 24 is closed by an outwardly inclined foil or lip 38 adapted to impart an additional lifting force to rotor assembly 16, as described below. The lower surface 40 of leading edge 34 is shaped so as to direct a stream of air into longitudinal channel 24, when toy 10 is in flight. While channel 24 is thus being filled with air, centrifugal and aerodynamic forces radially displace the air, previously trapped within channels 24, increasing its velocity and pressure. Thus, a lifting force is imparted to blades 14 as the air is expelled under the inclined surfaces 32 of closing lips 38 of channels 24.

This blade design has the particular advantage that, when toy 10 is in a free falling mode, during the return phase of flight, air flow enables blades 14 to windmill in the same direction as when powered by momentum, during the ascending phase of flight, as described below.

When toy 10 reaches the highest point of its powered flight path (FIG. 5) and begins to descend, a cushion of air is trapped within channels 24 of blades 14. As it continues to glide downward, the trapped air is compressed, and a portion flows under the lower surface 40 of leading edge 34 of blades 14, creating a region of lower pressure forward of leading edge 34, accordingly, lifting and rotational forces are exerted upon each blade. Further, as in power flight, air is radially displaced within each channel 24, as previously described, being expelled under closing lip 38 of channel 24 to add an additional lift. These effects enable toy 10 to slowly descend toward the launch site for easy retrieval.

Figure 4:
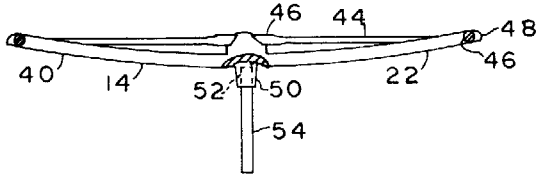
FIG. 4 is a sectional view along lines 4—4 of FIG. 1.

In order to enhance the aerodynamic stability of rotor assembly 16, blades 14 are typically formed in an upward arc from center (FIG. 4), but may be otherwise configured, when so desired, to alter the control and flight characteristics of rotor 16. A rim 42 is formed about rotor assembly 16 by four arcuate circular rod segments 44 which are attached by terminating stub 46 in a common plane with and adjacent rounded tips 48 of blades 14. This rim 42 provides increased angular momentum and enhances the gyroscopic stability of rotor assembly 16 once it is launched and at the same time provides a protective guard. A vertically disposed socket 50, centrally secured to hub 12, has central recess 52 adapted to frictionally retain elongated rod or handle 54. This rod 54 serves as an in-flight controller in a manner to be further described and as a means of retrieving toy 10 upon its return to the launching site.

Figure 5:
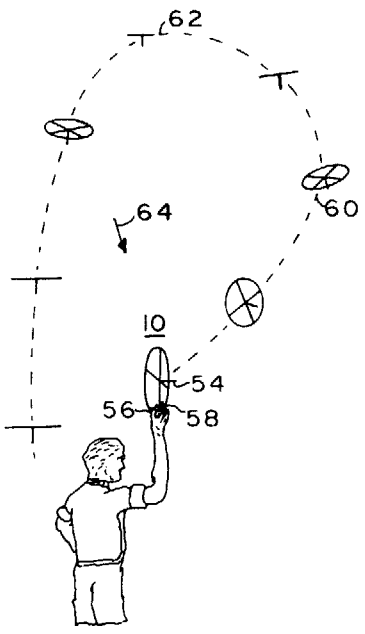
FIG. 5 is a diagrammatic view illustrating the operation of the invention.

In order to enable the toy boomerang 10 to execute a desirable return maneuver upon being launched, it is supported in the manner shown in FIG. 5 wherein an outer portion of one of blades 14 is gripped between the thumb 56 and the forefinger 58 with control handle 54 pointing toward the right side.

It is then held in an essentially upright position and in aligment with the expected plane of launch. While thus supported, it is thrown forward in an overhanded manner, being released at a point along the overhand arc which results in an upwardly inclined angle of about 45° when released.

The release is executed by momentarily retarding the blade 14 by which it is held, in order to spin the toy 10 in a clockwise direction as viewed from the right in FIG. 5. Immediately upon being launched, control handle 54 exerts a clockwise torque, as viewed from the launch site, on the spin axis, with the result that gyroscopic effects would typically cause it to turn toward the right in a well known manner. However, interacting aerodynamic forces enable toy 10 to be quickly oriented such that it is in an attitude, as shown at the midpoint 60 of its upward ascent (FIG. 5) wherein it is essentially horizontal, being tipped only slightly forward. Thus oriented, it is powered by angular momentum to the peak 62 of an eliptical course, where it assumes an essentially level attitude. Residual momentum of the torquing forces, however, cause it to tip slightly toward the right side, beyond a level attitude, and thus glide downward toward the launch site.

Although it is suggested that the toy 10 not be flown in high winds, a very good return pattern is achieved when it is launched at about 45° angle, as indicated by directional arrow 64, into winds having a steady velocity up to about 10 miles per hour.

It is found that the combination of features thus described result in a boomerang with significantly better performance than other known types and at the same time is a safe and enjoyable toy.

What is claimed is:

1. A boomerang comprising:

a hub region;

four elongated wing members extending outward from said hub region and being angularly spaced 90° apart in the same general plane, each comprising:

an upper convex surface and lower concave surface formed between leading and trailing edges, the combination of said surfaces providing lift and the concave lower surface providing a longitudinal channel extending between the hub region and the outer end region of a wing member, and a downwardly inclined region at the outer end of said channel of each wing member closing at the end of each channel and providing a downward movement of air and thus providing additional lift to said boomerang;

at least one rib extending outward from said hub region along the bottom surface of each said wing member;

a rim extending around the periphery of the boomerang, interconnecting outer end regions of said wing members; and a stabilizing axle attached to said hub region and extending downward in a direction generally perpendicular to the general plane of said wing members for providing an orienting force causing the boomerang to be rotated in flight to a horizontal operating plane with said stabilizing axle pointing downward following the boomerang being launched in a vertical plane.

* * * * *